US008130983B2

(12) United States Patent
Cheng

(10) Patent No.: US 8,130,983 B2
(45) Date of Patent: Mar. 6, 2012

(54) BODY MOTION CONTROLLED AUDIO PLAYING DEVICE

(76) Inventor: Tsung-Ming Cheng, Taipei (TW)

( * ) Notice: Subject to any disclaimer, the term of this patent is extended or adjusted under 35 U.S.C. 154(b) by 940 days.

(21) Appl. No.: 12/156,972

(22) Filed: Jun. 9, 2008

(65) Prior Publication Data

US 2009/0304208 A1 Dec. 10, 2009

(51) Int. Cl.
*H02B 1/00* (2006.01)

(52) U.S. Cl. ..... 381/123; 340/686.1; 345/156; 345/158; 381/104; 381/124

(58) Field of Classification Search ..... 381/123, 381/77, 81, 386, 124, 103–109, 111; 700/94; 340/692, 573.1, 573.4, 686.1; 345/156, 158; 715/863

See application file for complete search history.

(56) References Cited

U.S. PATENT DOCUMENTS

| | | | | |
|---|---|---|---|---|
| 5,097,981 | A * | 3/1992 | Degasperi et al. | 221/3 |
| 5,485,139 | A * | 1/1996 | Tarnovsky | 340/573.1 |
| 5,894,275 | A * | 4/1999 | Swingle | 340/692 |
| 7,127,074 | B2 * | 10/2006 | Landa | 381/94.5 |
| 7,834,847 | B2 * | 11/2010 | Boillot et al. | 345/156 |
| 2008/0048878 | A1 * | 2/2008 | Boillot | 340/686.1 |
| 2008/0134102 | A1 * | 6/2008 | Movold et al. | 715/863 |

* cited by examiner

*Primary Examiner* — Xu Mei
*Assistant Examiner* — Lun-See Lao

(57) ABSTRACT

A body motion controlled audio playing device is disposed with a sensing switch that can be covered in a non-contact way to selectively enable such functions as startup, shutdown, mute, and volume adjustment.

4 Claims, 10 Drawing Sheets

BODY MOTION CONTROLLED AUDIO PLAYING DEVICE

BACKGROUND OF THE INVENTION

1. Field of the Invention

The present invention relates to a body motion controlled audio playing device, and more particularly, to an audio playing device having a sensing switch that can be covered through body motion so as to control startup, shutdown, and volume.

2. Description of Related Art

Music is one of the ways to relieve stress. People often listen to music in order to relax and unleash emotions. Music is also a means to building an atmosphere as appropriate. An audio playing device (a speaker) is required for hi-fis, computers, radios, and MP3 players. External audio playing devices, which are much more common than built-in audio playing devices, can be increased or decreased as needed. FIGS. 1 and 2 show an external audio playing device 1 in wide use. Referring to the drawings, the audio playing device 1 is equipped with a switch 11 for volume adjustment, startup, and shutdown. The switch 11 comes in various forms, namely a knob, a button, a toggle switch, etc. Operation of the aforesaid forms of switches entails contact and therefore tends to end up with poor contact, detachment, or damage after prolonged use. More badly, contact switches are typically of low sensitivity and therefore unfit for precise volume adjustment.

Hence, the technological breakthrough to be achieved by the inventor of the present invention involves elimination of the above drawbacks.

SUMMARY OF THE INVENTION

In view of the above drawbacks of the prior art, the inventor of the present invention collected related data, conducted comprehensive evaluation, gave all-encompassing consideration, carried out test runs and amendment repeatedly, and, based on the inventor's years of experience in the art, eventually devised a body motion controlled audio playing device worthy of patent protection.

It is a primary objective of the present invention to provide an audio playing device disposed with a sensing switch that can be covered manually or by any object at different time slots so as to selectively enable such functions as startup, shutdown, mute, and volume adjustment.

Another objective of the present invention is to provide an audio playing device disposed with a sensing switch of a non-contact type so as to reduce wear and tear which might otherwise occur to overdriven conventional contact switches, thereby prolonging service life and promoting fun.

DETAILED DESCRIPTION OF THE PREFERRED EMBODIMENTS

The present invention is herein illustrated with preferred embodiments, so that one skilled in the pertinent art can easily understand technical means and structures required to achieve the aforesaid objectives and effects, and other advantages and features of the present invention, from the disclosure of the invention.

Figure 1:
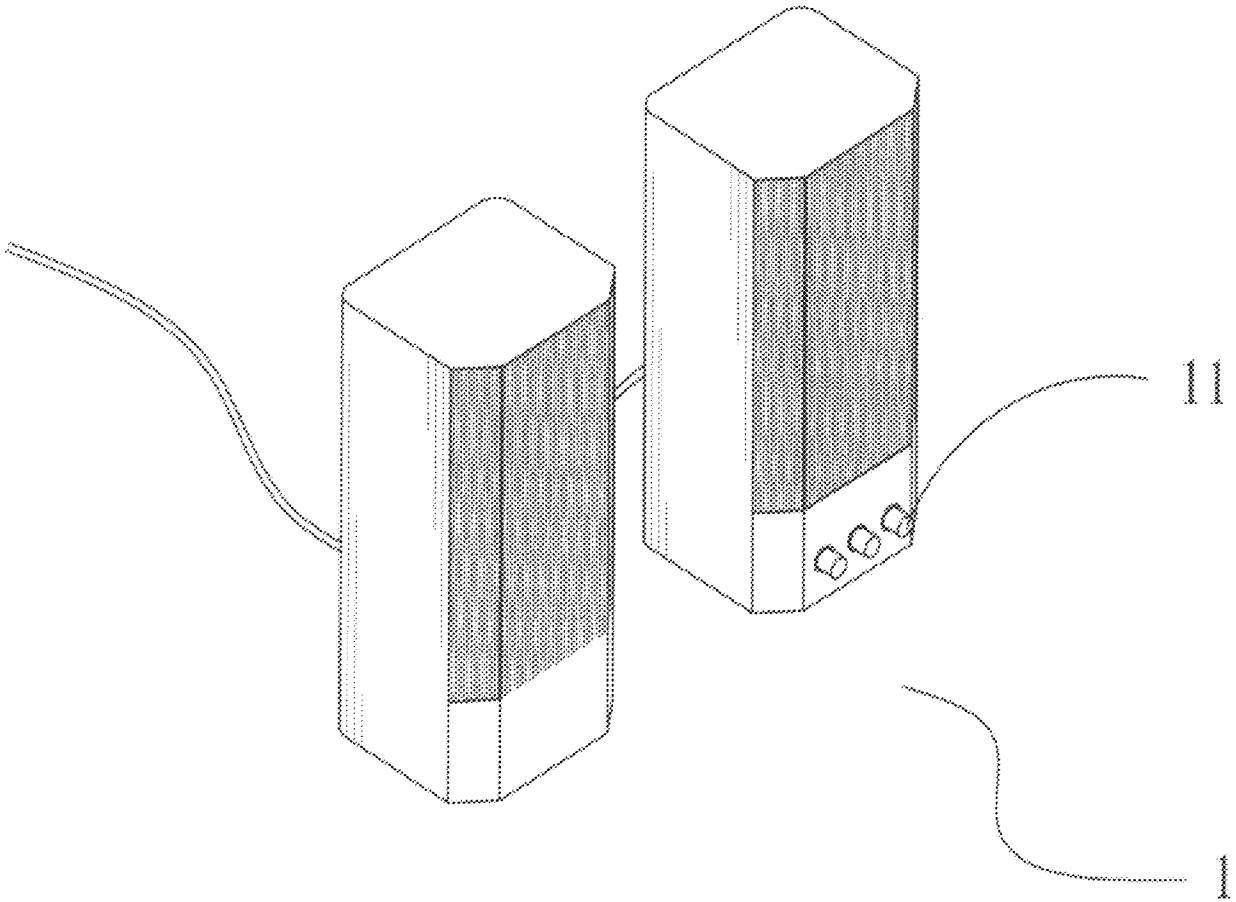
FIG. 1 is a perspective view of the prior art.
Figure 2:
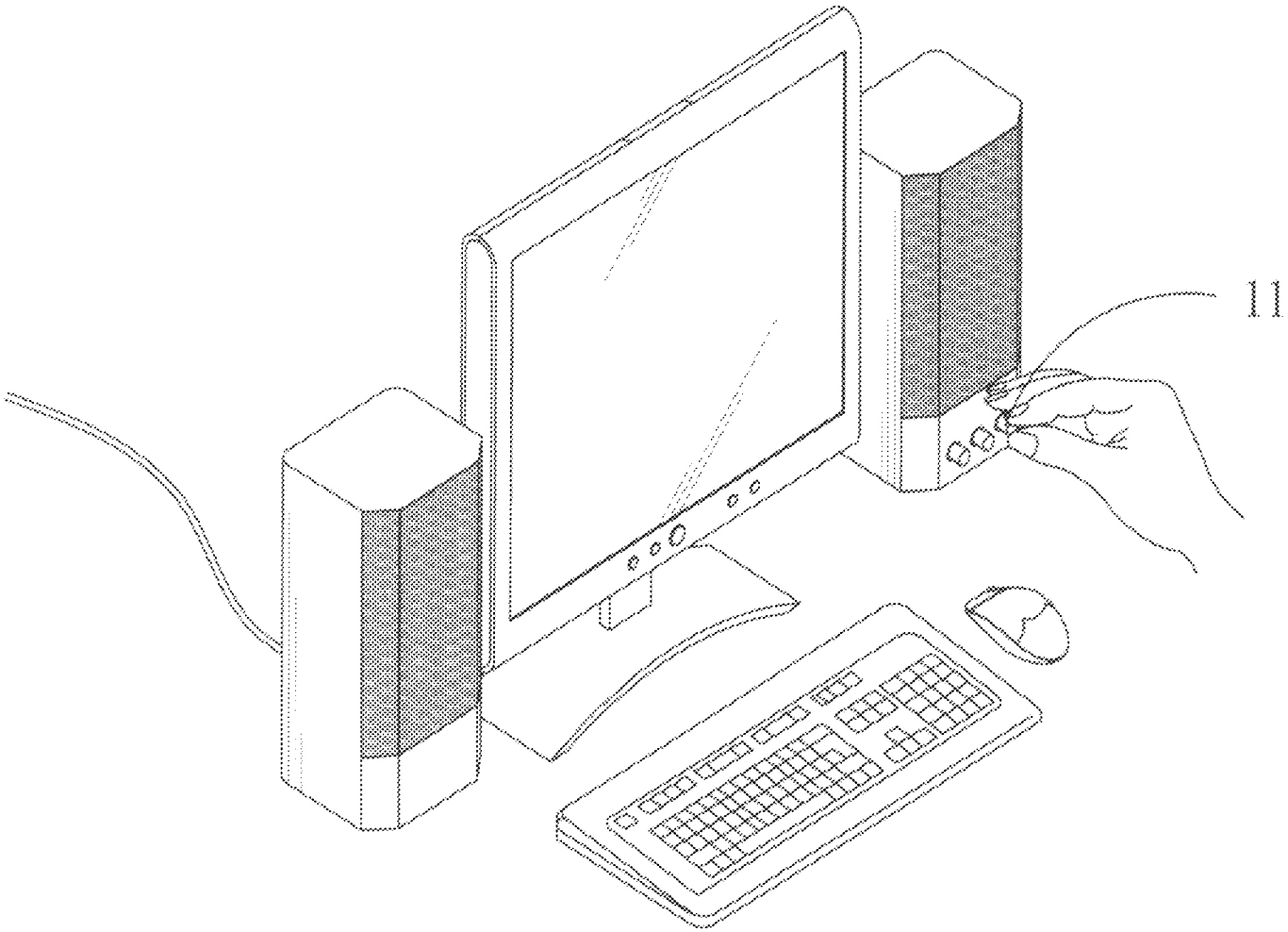
FIG. 2 is a perspective view showing an embodiment of the prior art.
Figure 3:
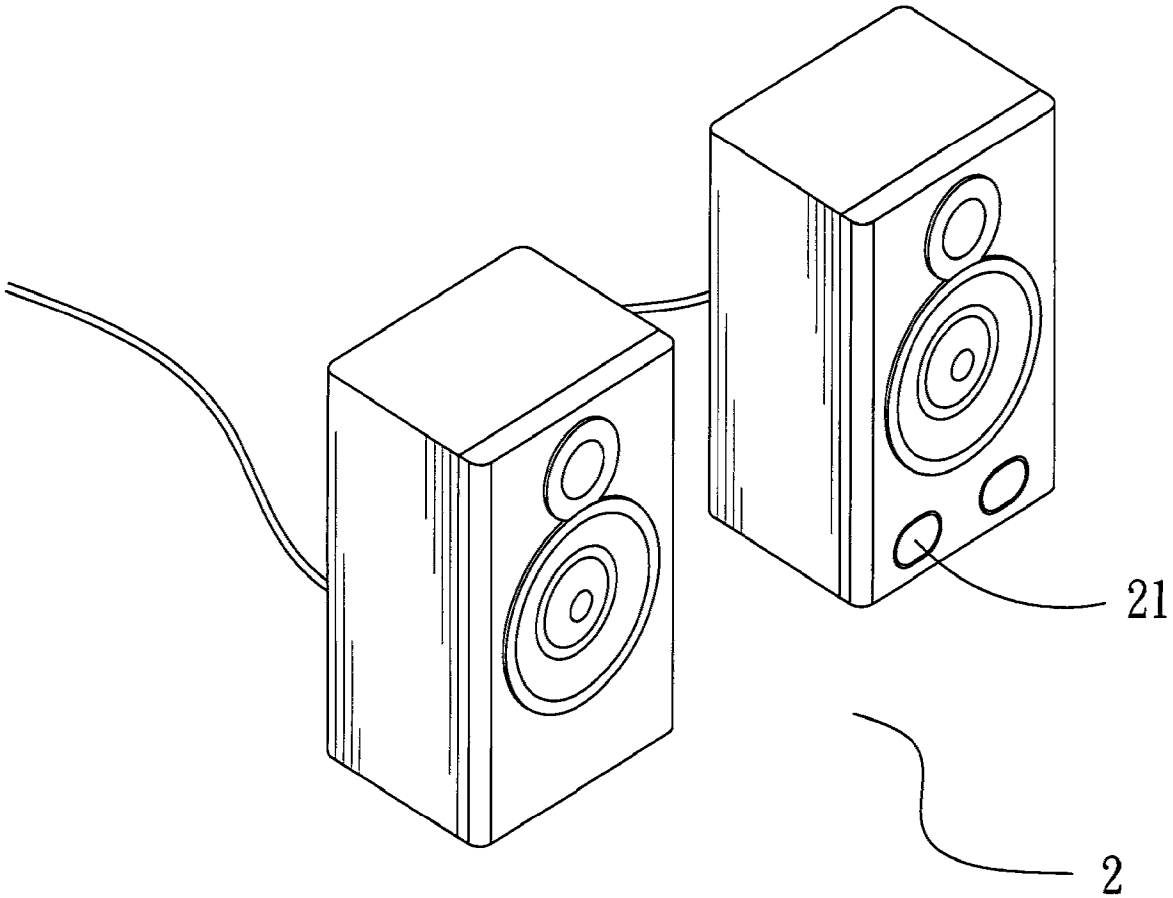
FIG. 3 is a perspective view of the present invention.

Referring to FIG. 3, which is a perspective view of the present invention, at least one of the audio playing devices 2 is disposed with sensing switches 21. The sensing switches 21 are non-contact switches such as, for example, light sensing devices, thermal sensing devices, infrared sensing devices, and temperature sensing devices. The primary function of the sensing switches 21 is to detect a covering body part or object. The sensing switches 21 are covered at different time slots or at different frequencies so as to enable the audio playing device 2 to switch between startup, shutdown, mute, and volume adjustment. In the present invention, the audio playing device 2 is disposed with one, two, or three sensing switches 21, as described below.

Figure 4:
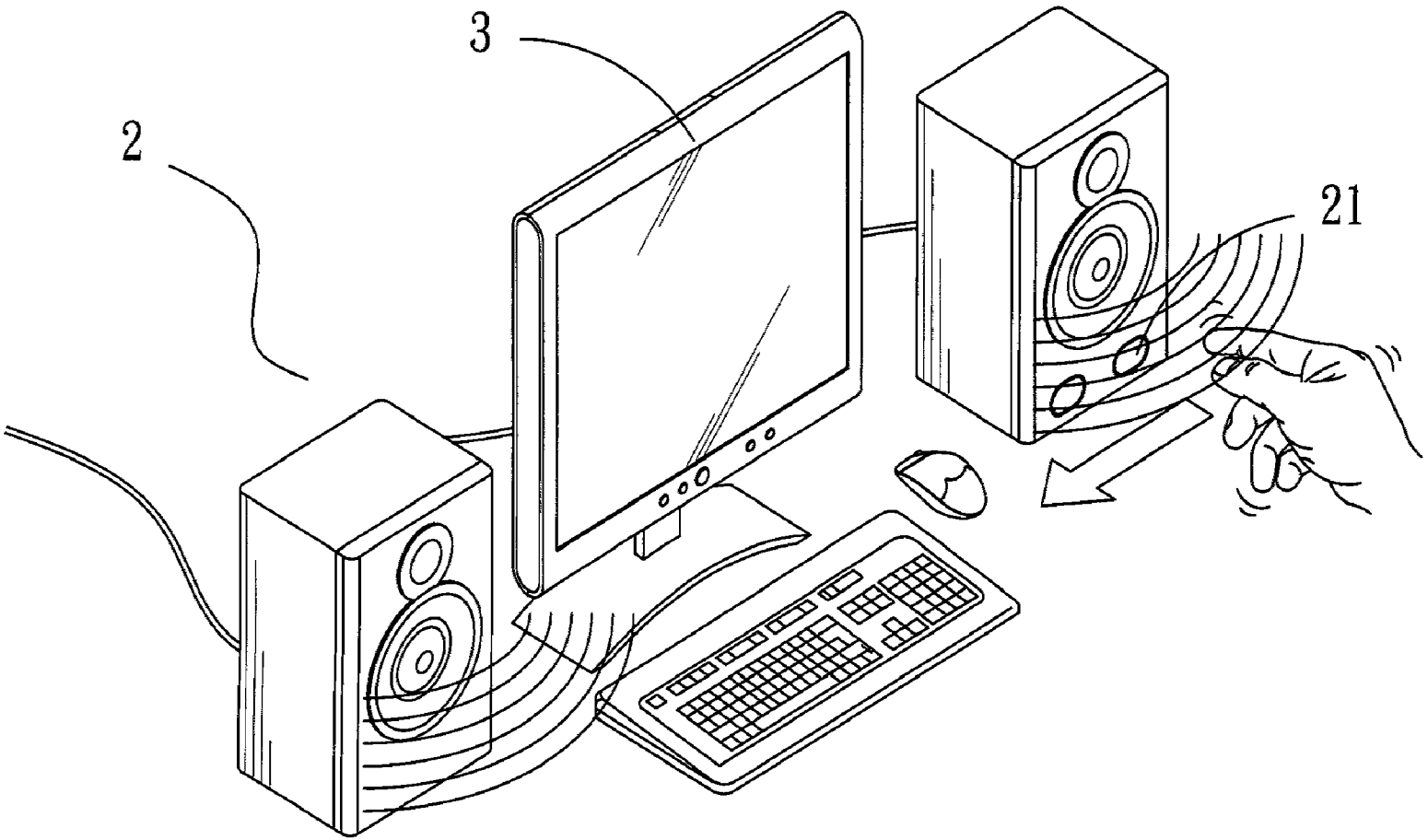
FIG. 4 is a perspective view showing a first preferred embodiment of the present invention.
Figure 5:
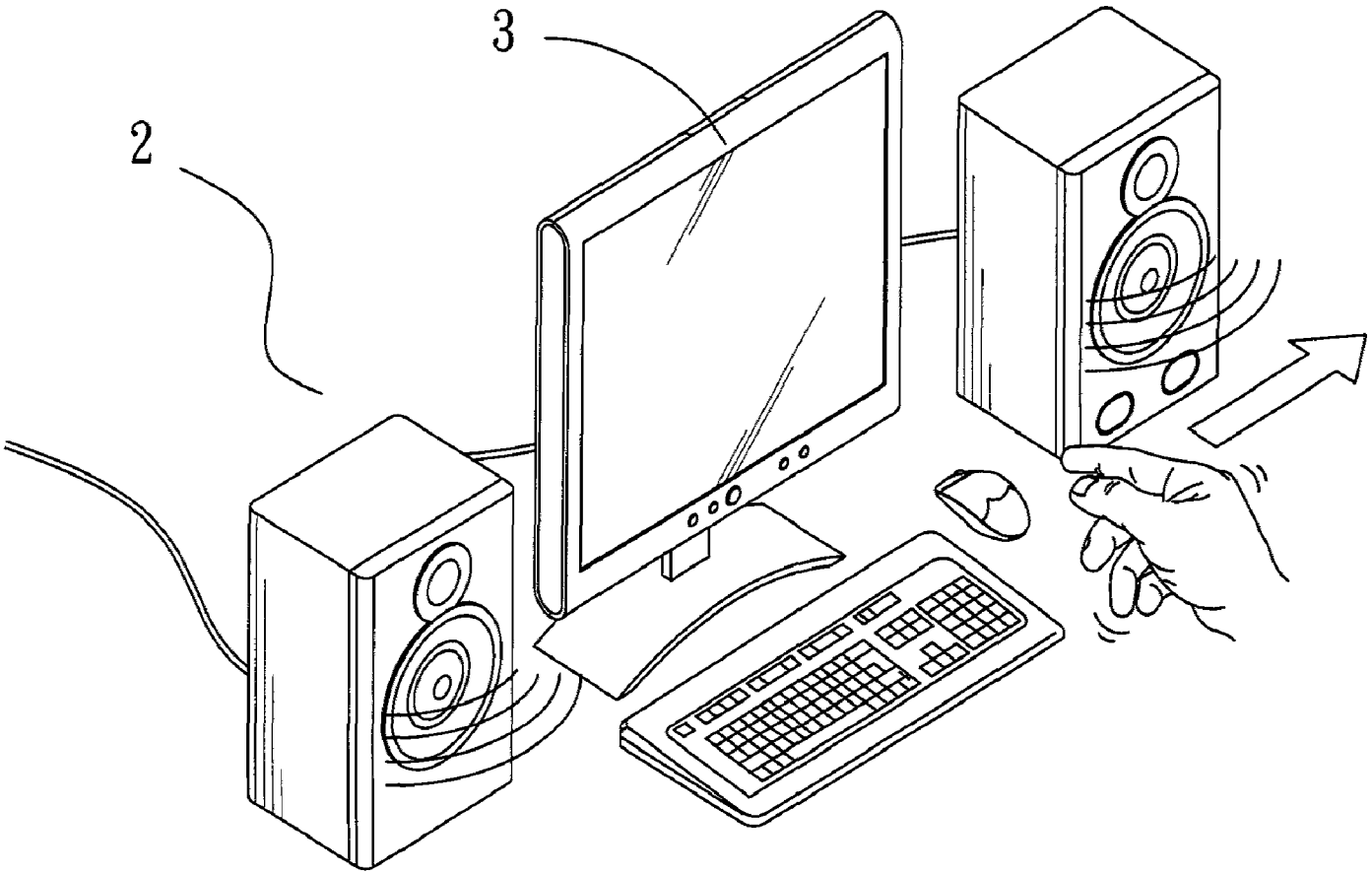
FIG. 5 is another perspective view showing the first preferred embodiment of the present invention.
Figure 6:
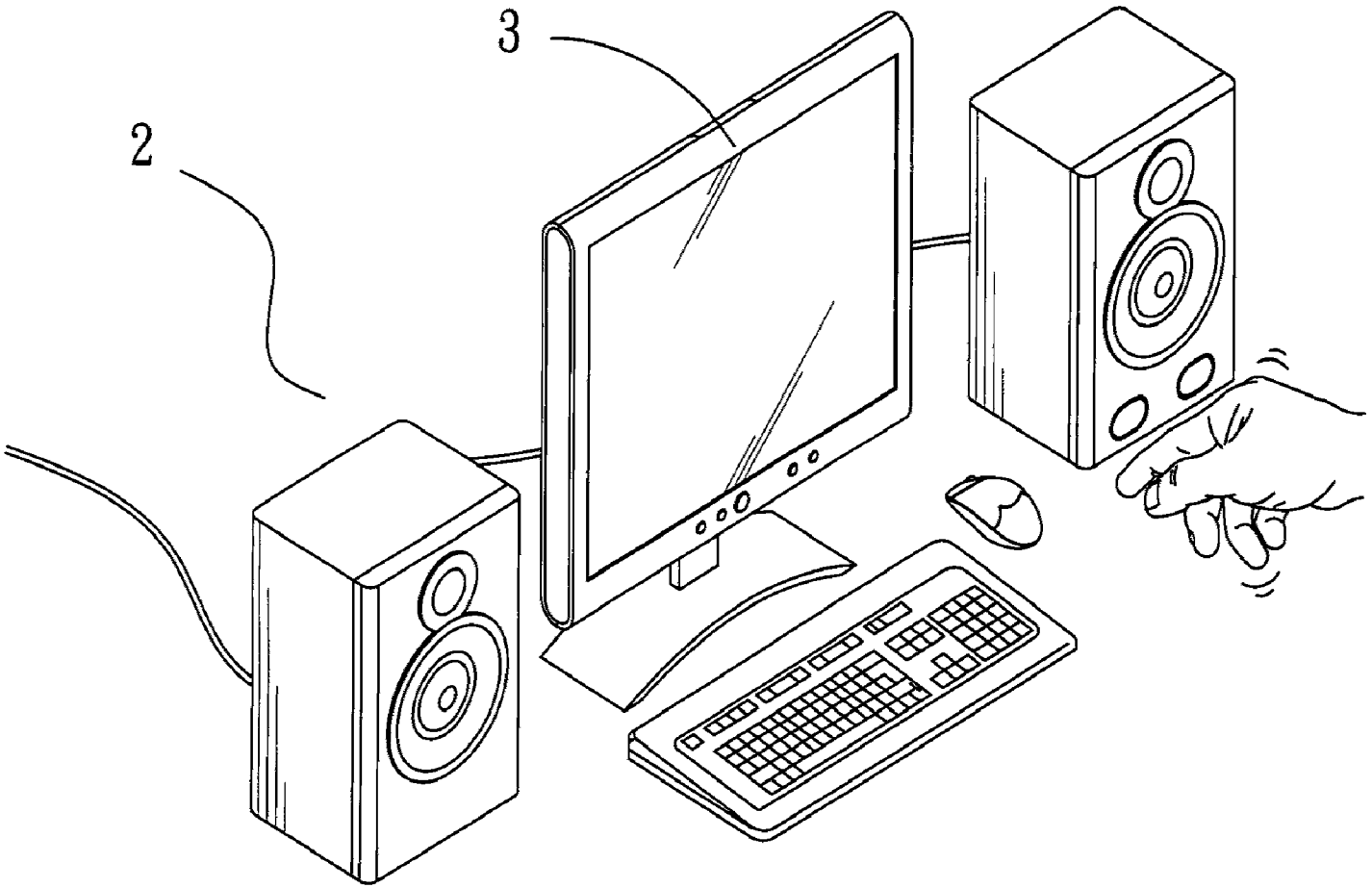
FIG. 6 is yet another perspective view showing the first preferred embodiment of the present invention.

Referring to FIGS. 4, 5, and 6, which are perspective views showing a first preferred embodiment of the present invention, the audio playing device 2 is disposed with two sensing switches 21. The two sensing switches 21 adjust the volume of the audio playing device 2 whenever a hand or an object passes the two sensing switches 21, either from left to right or from right to left, at different time slots. The audio playing device 2 becomes mute as soon as both of the sensing switches 21 are simultaneously covered by the hand or the object. The volume of the audio playing device 2 can be turned up when a hand or an object passes from right to left and covers the two sensing switches 21 in sequence, and turned down when the hand or object passes from left to right and covers the two sensing switches 21 sequentially. In the preferred embodiment, the audio playing device 2 is controlled, for example, by a comparator, a differential amplifier, or an audio frequency controller connected to the sensing switches 21, or by an electronic component, such as a programmable controller, operating in conjunction with the sensing switches 21.

Figure 7:
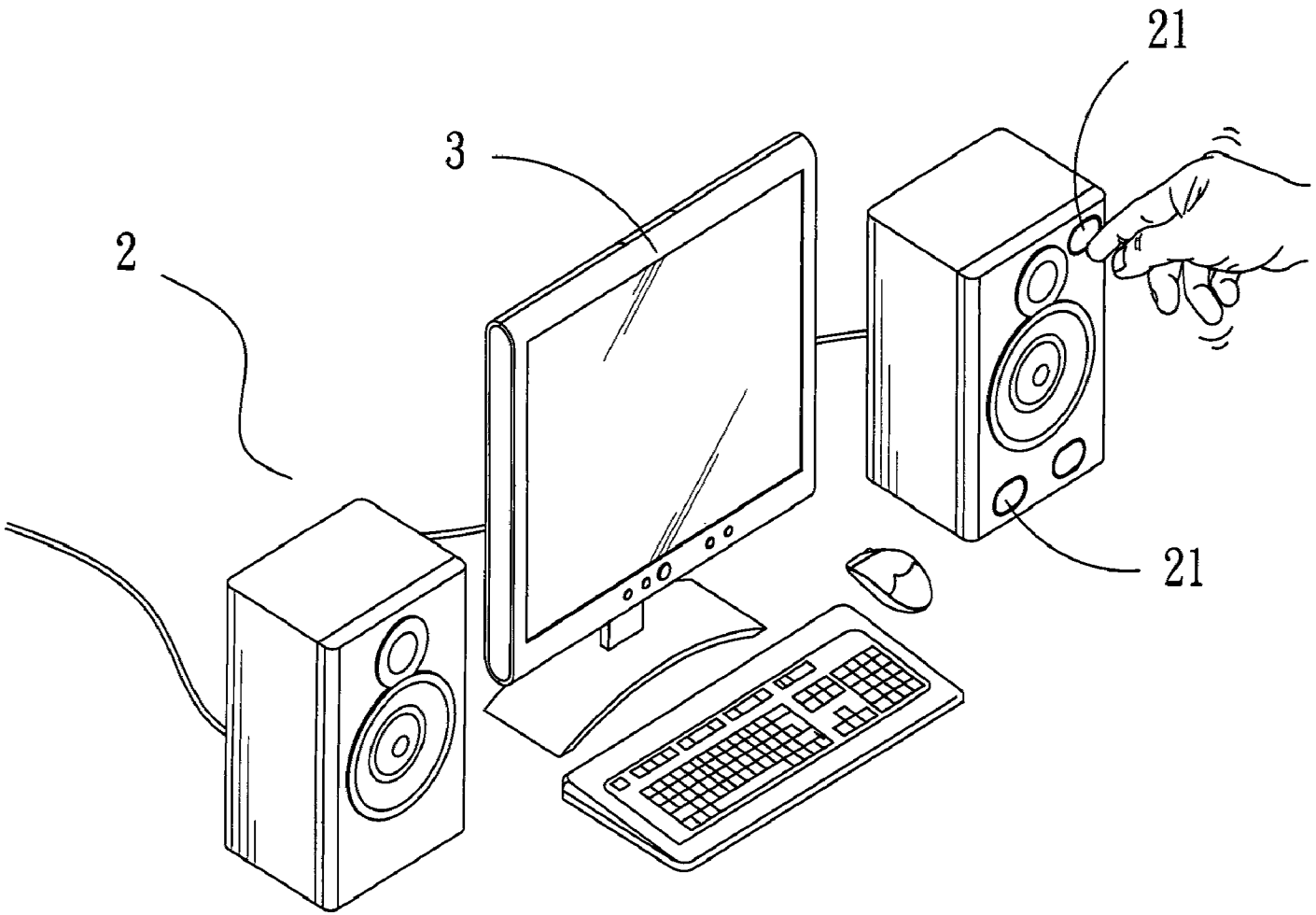
FIG. 7 is a perspective view showing a second preferred embodiment of the present invention.

Referring to FIG. 7, which is a perspective view showing a second preferred embodiment of the present invention, in addition to the two sensing switches 21, the audio playing device 2 is further disposed with a third sensing switch 21 at an upper portion of the audio playing device 2, such that the third sensing switch 21 at the upper portion of the audio playing device 2 can be repeatedly covered so as to start up the audio playing device 2, shut down the audio playing device 2, and cause the audio playing device 2 to play the next song, successively.

Figure 8:
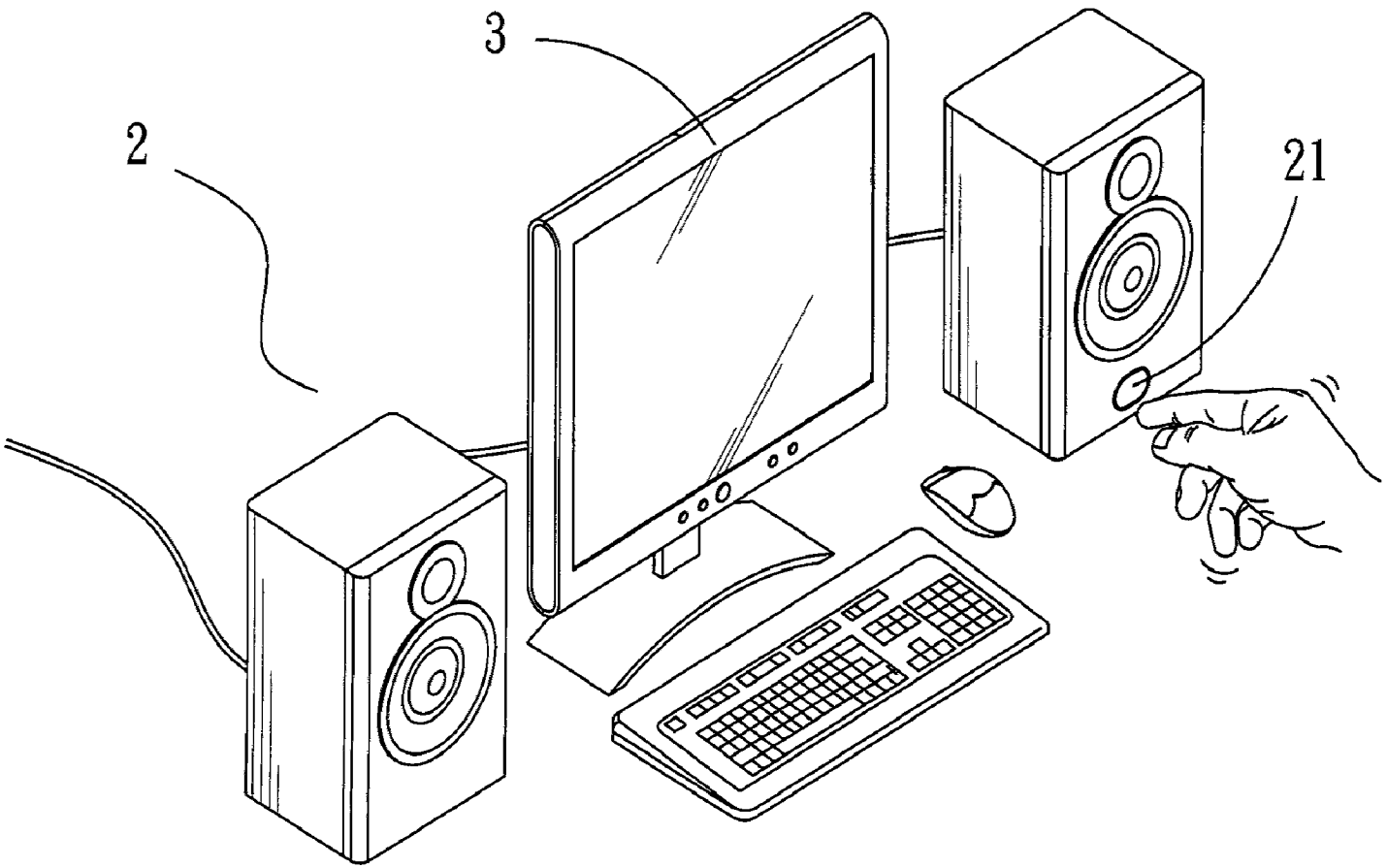
FIG. 8 is a perspective view showing a third preferred embodiment of the present invention.

Referring to FIG. 8, which is a perspective view showing a third preferred embodiment of the present invention, the audio playing device 2 is disposed with one and only one sensing switch 21, such that the sensing switch 21 can be repeatedly covered to start up, shut down, and mute the audio playing device 2 successively.

Figure 9:
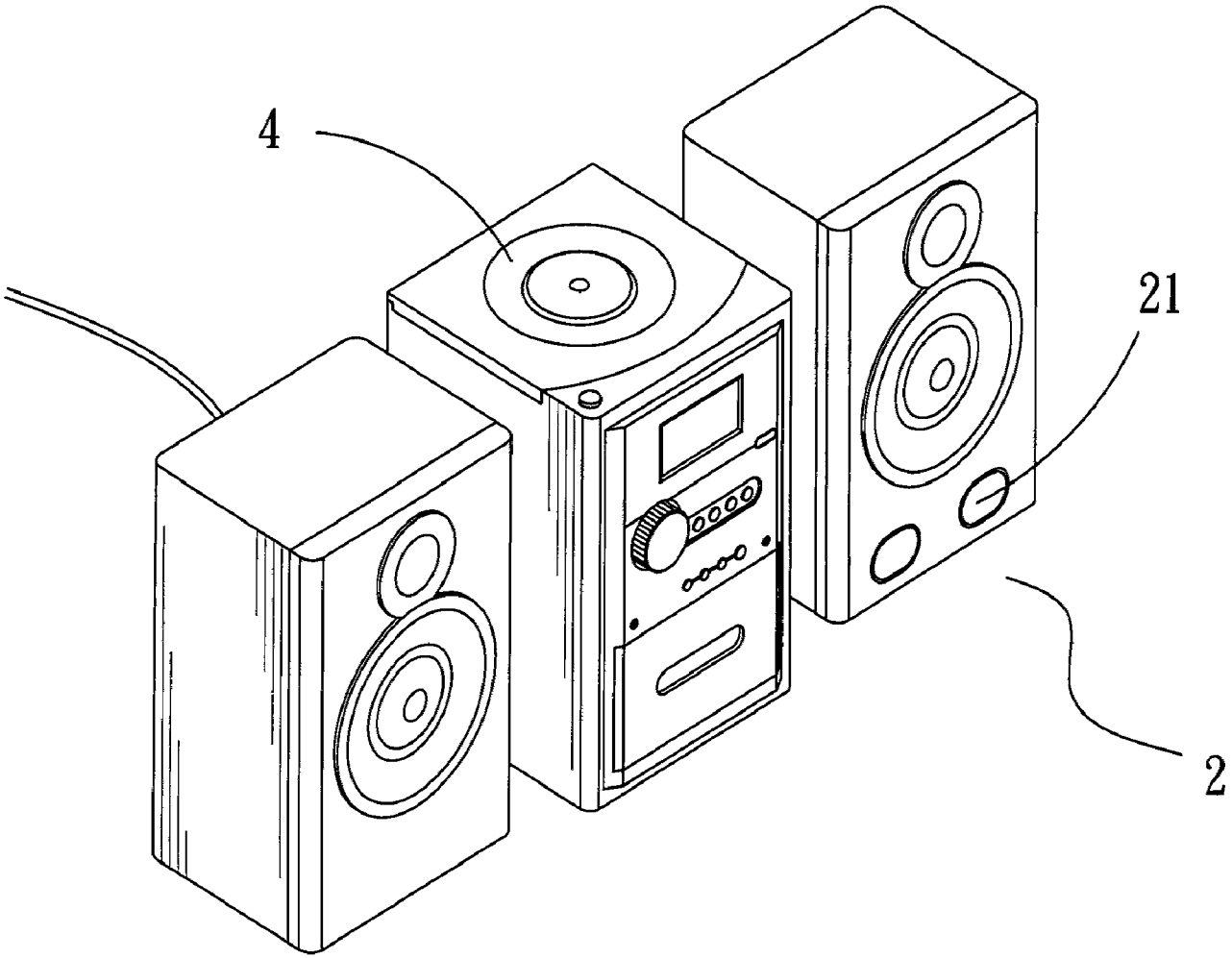
FIG. 9 is a perspective view showing a fourth preferred embodiment of the present invention.
Figure 10:
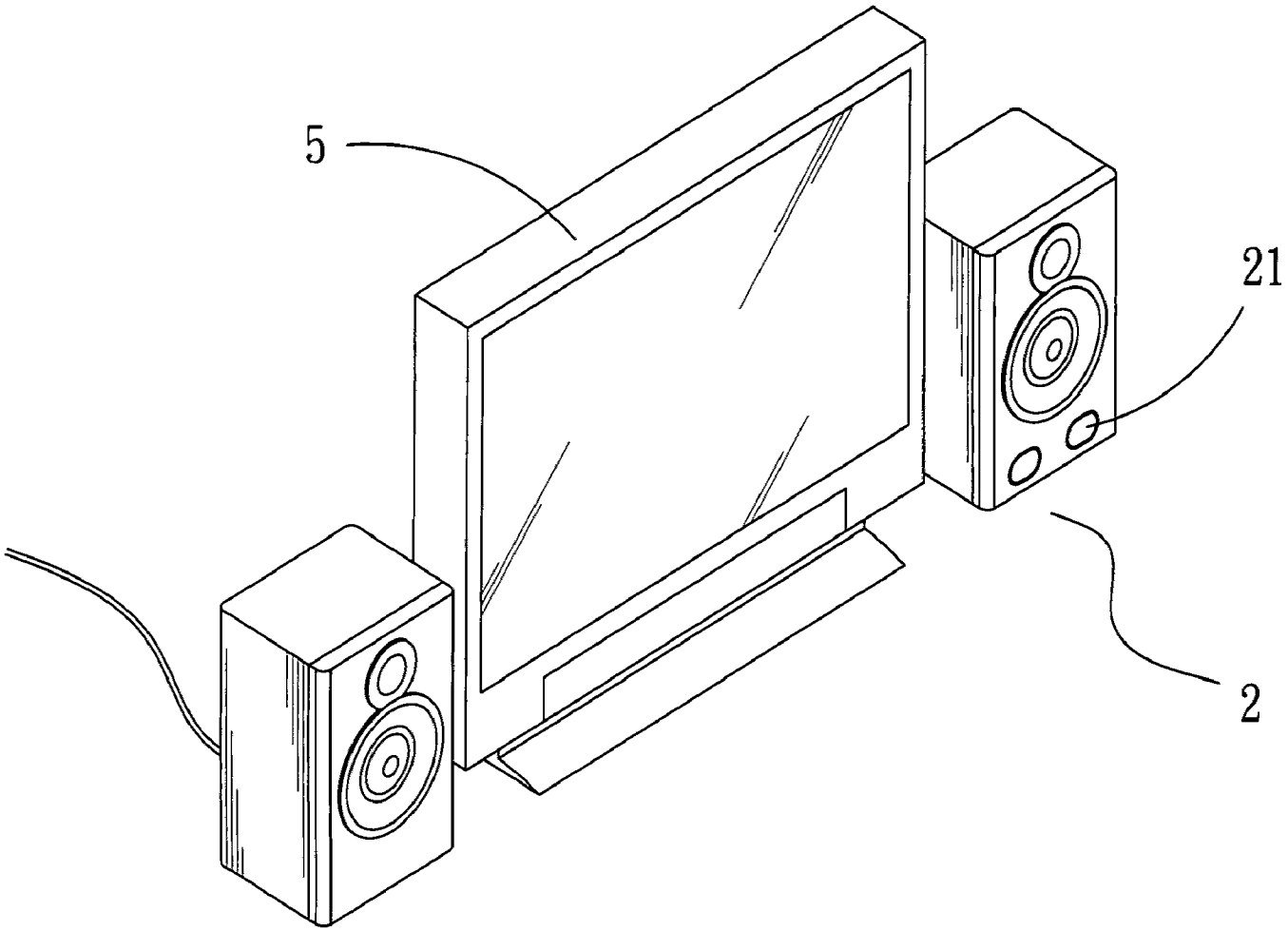
FIG. 10 is a perspective view showing a fifth preferred embodiment of the present invention.

Referring to FIGS. 9 and 10, which are perspective views showing a fourth and a fifth preferred embodiment of the present invention, the audio playing device 2 operating in conjunction with hi-fi equipment 4, audiovisual equipment 5, or any other multimedia equipment is disposed with the sensing switches 21 to enable the audio playing device 2 to switch between startup, shutdown, mute, and volume adjustment.

Any of the sensing switches 21 disposed on the audio playing device 2 is a non-contact device, such as a light sensing device, a thermal sensing device, an infrared sensing device, and a temperature sensing device. Working without being touched, the non-contact sensing switches 21 are free of wear and tear that is common among conventional contact switches such as knobs, buttons, and toggle switches after prolonged use, and therefore have a longer service life.

What is claimed is:

1. A body motion controlled audio playing device, the audio playing device being essentially disposed with two switch for controlling the audio playing device, characterized in that the switch disposed on the audio playing device is a non-contact sensing switch allowing the audio playing device to switch between startup, shutdown, mute, and volume adjustment;

wherein the at least two sensing switches adjust the volume of the audio playing device when a hand passes the two sensing switches, either from left to right or from right to left, at different time slots; the audio playing device becomes mute as soon as both of the sensing switches are simultaneously covered by the hand; the volume of the audio playing device can be turned up when a hand passes from right to left and covers the two sensing switches in sequence, and turned down when the hand passes from left to right and covers the two sensing switches sequentially.

2. The body motion controlled audio playing device of claim 1, wherein the sensing switch is a non-contact device selected from the group consisting of a light sensing device, a thermal sensing device, an infrared sensing device, and a temperature sensing device.

3. The body motion controlled audio playing device of claim 1, wherein the audio playing device is disposed with at least one sensing switch capable of sensing simultaneously or sensing at different time slots, so as to mute, turn up, and turn down the audio playing device and cause the audio playing device to play a next song.

4. The body motion controlled audio playing device of claim 1, wherein the audio playing device is disposed with one and only said sensing switch such that repeatedly covering said sensing switch enables the audio playing device to switch between startup, shutdown, and mute.

* * * * *